US007793527B2

(12) United States Patent
Shen

(10) Patent No.: US 7,793,527 B2
(45) Date of Patent: Sep. 14, 2010

(54) REINFORCED HANDLE ASSEMBLY FOR LOCK

(75) Inventor: Mu-Lin Shen, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 66 days.

(21) Appl. No.: 11/781,696

(22) Filed: Jul. 23, 2007

(65) Prior Publication Data

US 2008/0011028 A1 Jan. 17, 2008

Related U.S. Application Data

(63) Continuation-in-part of application No. 11/306,884, filed on Jan. 13, 2006, now abandoned.

(51) Int. Cl.
*G05G 5/00* (2006.01)
*E05B 13/10* (2006.01)

(52) U.S. Cl. ..... 70/224; 70/216; 70/221; 292/336.3; 292/347

(58) Field of Classification Search ..... 70/207, 70/209, 210, 215, 216, 218, 221, 222, 224; 292/336.3, 347, 348; 262/336.3
See application file for complete search history.

(56) References Cited

U.S. PATENT DOCUMENTS

| | | | | |
|---|---|---|---|---|
| 3,604,229 | A | 9/1971 | Wake | 70/223 X |
| 4,424,691 | A | 1/1984 | Foshee | 70/224 |
| 5,317,889 | A * | 6/1994 | Solovieff et al. | 70/224 |
| 5,598,726 | A | 2/1997 | Cordle | 70/224 |
| 5,727,406 | A * | 3/1998 | Banducci | 70/224 |
| 5,768,926 | A | 6/1998 | Shen | 70/472 |
| 5,794,472 | A | 8/1998 | Kester et al. | 70/472 |
| 5,868,018 | A | 2/1999 | Kang | 70/472 |
| 5,992,189 | A | 11/1999 | McCaa | 70/149 |
| 6,014,878 | A | 1/2000 | Shen | 70/472 |
| 6,021,654 | A | 2/2000 | McCaa | 70/149 |
| 6,041,630 | A | 3/2000 | Shen | 70/472 |
| 6,108,979 | A * | 8/2000 | Saffran et al. | 292/336.3 |
| 6,189,351 | B1 | 2/2001 | Eagan et al. | 70/472 |
| 6,216,500 | B1 | 4/2001 | Kang | 70/224 |
| 6,279,360 | B1 | 8/2001 | Shen | 70/224 |
| 6,351,976 | B1 | 3/2002 | Chen | 70/224 |
| 6,497,126 | B2 | 12/2002 | Wang | 70/472 |
| 6,575,006 | B1 | 6/2003 | Don | 70/472 |
| 6,615,630 | B2 | 9/2003 | Wu et al. | 70/472 |
| 6,705,138 | B1 | 3/2004 | Shen | 70/224 |
| 2001/0023600 | A1 * | 9/2001 | Pompeii | 70/224 |
| 2004/0237608 | A1 * | 12/2004 | Chen | 70/224 |

* cited by examiner

*Primary Examiner*—Peter M Cuomo
*Assistant Examiner*—Christopher Boswell
(74) *Attorney, Agent, or Firm*—Alan Kamrath; Kamrath & Associates PA

(57) ABSTRACT

A lock includes a handle, a hub, and a spindle rotatably mounted in the hub and coupled to the handle to turn therewith. A transmission member is fixed to the handle to turn therewith. The transmission member is mounted around and not rotatably engaged with the spindle. The transmission member is stopped by the hub after the handle has been turned through an angle, transmitting a torque from the handle to the hub via the transmission member. Thus, impact from the handle can be partly transmitted to the hub and then to a door on which the lock is mounted, instead of completely transmitted to the spindle. Damage to the spindle is, thus, avoided.

6 Claims, 7 Drawing Sheets

REINFORCED HANDLE ASSEMBLY FOR LOCK

CROSS REFERENCE TO RELATED APPLICATION

This is a continuation-in-part application of U.S. patent application Ser. No. 11/306,884 filed Jan. 13, 2006, now abandoned.

BACKGROUND OF THE INVENTION

1. Field of the Invention

The present invention relates to a handle assembly. More particularly, the present invention relates to a handle assembly for a lock.

2. Description of the Related Art

The outside handle of a conventional door lock could not be turned when in a locked state. However, the inner parts of the lock may be damaged after frequent tuning of the outside handle in the locked state. U.S. Pat. No. 6,705,138 discloses a clutch mechanism for a lock in which the outside handle rotates freely when the lock is in a locked state so that damage to the inner parts of the lock is avoided.

More specifically, as illustrated in FIG. 1 of the drawings, the lock disclosed in U.S. Pat. No. 6,705,138 includes an outside handle 31, an outside spindle 41 having an end fixed to the outside handle 31, a cam 42 received in an end of the outside spindle 41 and releasably engaged with a retractor 52 of a latch mechanism 5, a sleeve 43 received in the cam 42 and securely engaged with a locking bar 14 to turn therewith, and a lug 44 that is movable together with the cam 42 in a longitudinal direction and that is pivotally mounted around an end of the sleeve 43. When the locking bar 14 is moved inward to a locking position as a result of pushing a push button 15, the cam 42 is disengaged from the retractor 52 so that the outside handle 31 turns freely, preventing damage to the inner parts of the lock.

However, it was found that, after the outside handle 31 and the outside spindle 41 had been turned freely through a pre-determined angle (typically 45 degrees or 60 degrees), further free rotation of the outside handle 31 was stopped by a lock housing comprised of an outside hub 33 and an inside hub 13, causing an impact to the outside handle 31 and the outside spindle 41. As a result, stress concentration occurred in the coupling area between the outside handle 31 and the outside spindle 41 that is relatively weak as compared to other parts of the lock, resulting in damage to or breakage of the outside spindle 41.

More specifically, referring to FIG. 1, the outside handle 31 is coupled with the outside spindle 41 by a spring-biased engaging plate 48 that extends in a plane orthogonal to the longitudinal direction of the outside spindle 41. The outside spindle 41 includes two holes 410*a* and 410*b*. A spring 47 is mounted between the engaging plate 48 and the outside spindle 41 for biasing the engaging plate 48 to a pre-determined position, with an end of the spring 47 extending out of the outside spindle 41 via one of the holes (e.g., hole 410*a*), and with the other hole 410*b* providing a space allowing inward movement of the engaging plate 48. The outside handle 31 includes a groove 311 for receiving an end of the engaging plate 48 when the outside handle 31 is mounted around the outside spindle 41, thereby positioning the outside handle 31.

Formation of the holes 410*a* and 410*b* weakens the outside spindle 41. Namely, the weakest portion of the outside spindle 41 is the place to which the engaging plate 48 is engaged. As a result, when the lock is in the locked state and when the outside handle 31 and the outside spindle 41 have been turned through a pre-determined angle, further rotational force applied to the outside handle 31 causes damage to and breakage of the outside spindle 41 at the weakest portion.

It is, therefor, a need for a reinforced handle assembly for a lock capable of preventing damage to the spindle resulting from a torque applied to a handle that has been turned through a pre-determined angle.

BRIEF SUMMARY OF THE INVENTION

The present invention solves this need and other problems in the field of reinforced handle assemblies for locks by providing, in a preferred form, a lock including a hub having a pair of protrusions formed on an inner periphery thereof and angularly spaced from each other. A spindle is rotatably mounted in the hub and coupled to the handle to turn therewith. A transmission member is fixed to the handle to turn therewith. The transmission member is mounted around and not rotatably engaged with the spindle. The transmission member includes a longitudinal hole through which the spindle extends. A stop is formed on an inner side of the transmission member facing the hub and is slideable between the protrusions of the hub when the handle is turned. The stop is stopped by one of the protrusions of the hub after the handle has been turned through an angle by a rotational force. When torque is applied to the handle that has been turned through the angle, the torque is imparted to the hub via the transmission member preventing the spindle from being damaged by the torque.

In the most preferred form, the handle includes a shank having an inner periphery with a protrusion and a recess aligned with the protrusion. An engaging portion is formed on an outer face of the transmission member facing the handle and is coupled with the recess of the shank to allow joint rotation of the transmission member and the handle. The spindle further includes a coupling groove in an outer periphery thereof and includes a notch angularly spaced from the coupling groove by a first angle. The notch of the spindle is coupled with the protrusion of the shank of the handle. The transmission member further includes a key on an inner periphery defining the longitudinal hole and angularly spaced from the engaging portion by a second angle the same as the first angle between the coupling groove and the notch of the spindle. The key of the transmission member is coupled with the coupling groove of the spindle to allow joint rotation of the transmission member and the spindle. A torsion spring is mounted around the spindle and includes two tangs respectively pressing against two sides of one of the protrusions of the hub. A positioning ring is mounted around the spindle for preventing disengagement of the torsion spring from the hub. The positioning ring includes a restraining groove in an outer periphery thereof. Two end walls delimiting the restraining groove respectively abut against the protrusions of the hub. The stop of the transmission member slideably extends through the restraining groove of the positioning ring.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
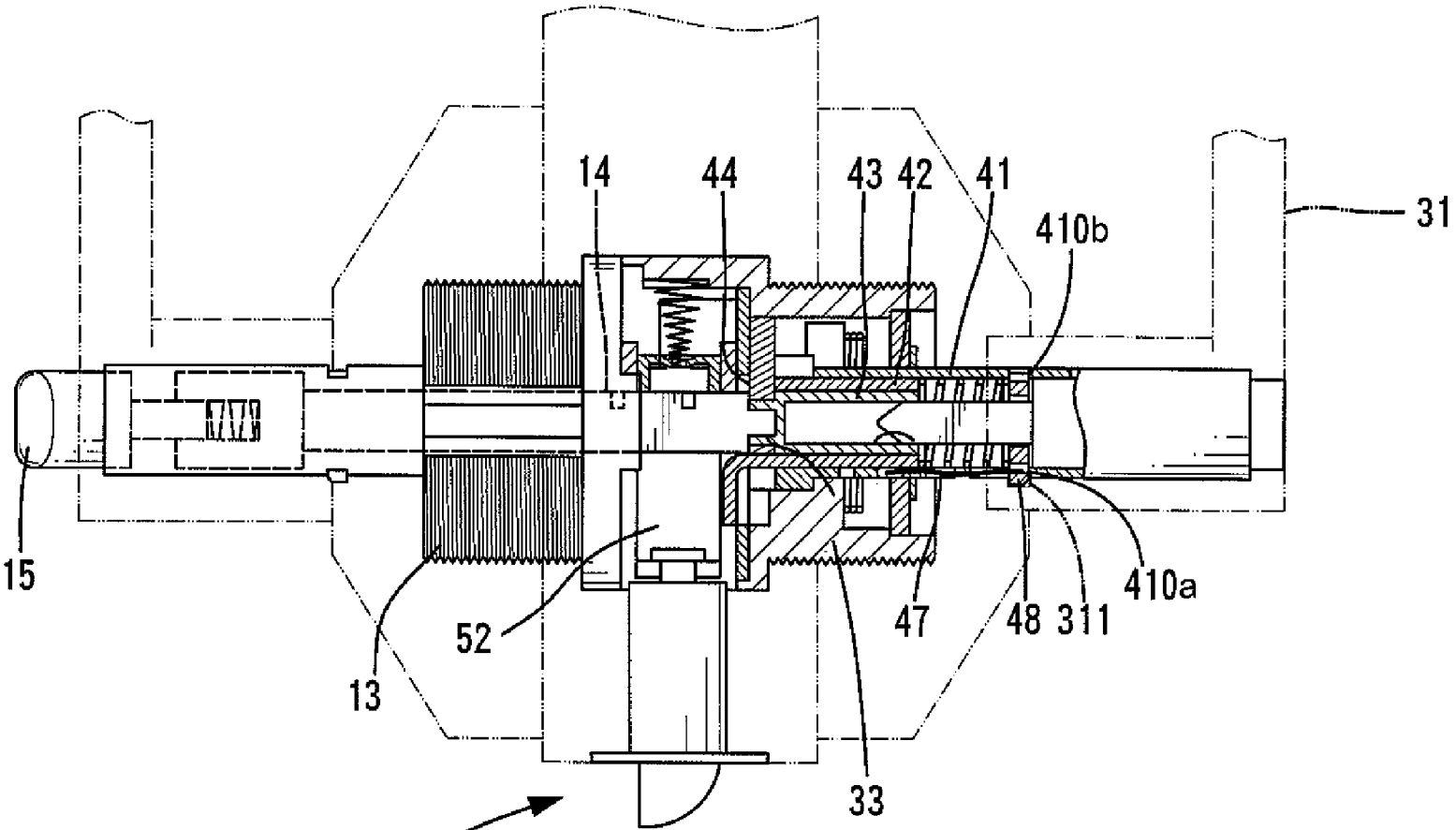
FIG.1 PRIOR ART
FIG. 1 is a sectional view of a conventional lock.
Figure 2:
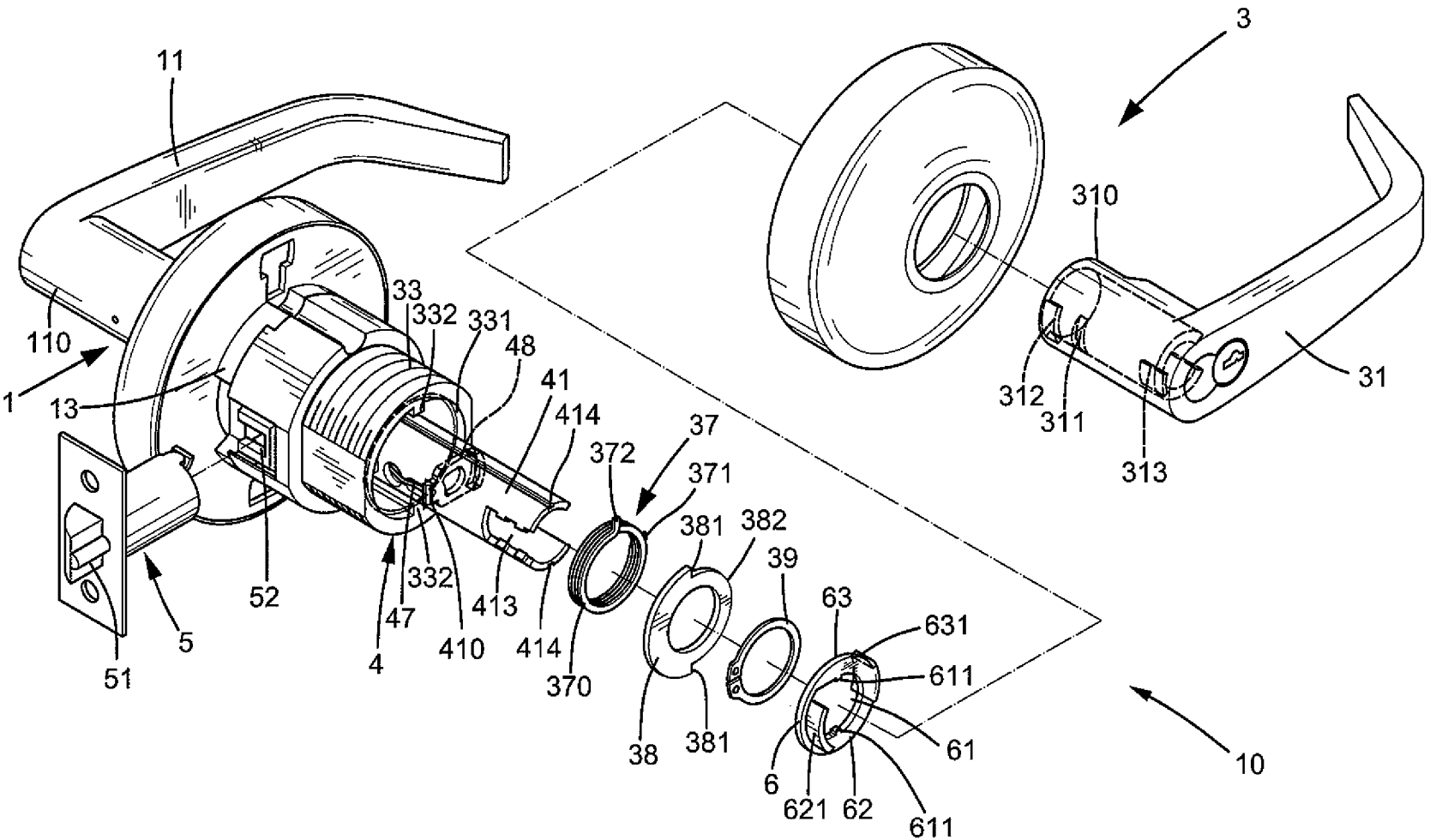
FIG. 2 is an exploded, perspective view of a lock with a reinforced handle assembly according to the preferred teachings of the present invention.

All figures are drawn for ease of explanation of the basic teachings of the present invention only; the extensions of the Figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "end", "portion", "inside", "outside", "inner", "outer", "longitudinal", "horizontal", "angular", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A lock with a reinforced handle assembly according to the preferred teachings of the present invention is illustrated in FIGS. 2 to 7 and generally designated 10. According to the preferred form, the lock 10 includes an inside handle assembly 1, an inside spindle 2, an outside handle assembly 3, an outside transmission assembly 4, and a latch mechanism 5. The outside handle assembly 3 is reinforced as compared to conventional designs, which will be described in detail later.

The inside handle assembly 1 includes an inside handle 11 coupled to the inside spindle 2 to turn therewith. The inside spindle 2 is mounted in an inside hub 13. The outside handle assembly 3 includes an outside handle 31. The outside transmission assembly 4 includes an outside spindle 41 that is coupled to the outside handle 31 to turn therewith. An inner end of the outside spindle 41 is mounted in an outside hub 33. The inside hub 13 and the outside hub 33 together form a lock housing for receiving the latch mechanism 5. The latch mechanism 5 includes a latch bolt 51 and a retractor 52 that is operably connected to the latch bolt 51 and that is movable between a latching position and an unlatching position.

The outside transmission assembly 4 further includes an engaging plate 48 and a spring 47 for biasing the engaging plate 48. The engaging plate 48 extends through a hole 410 in the outside spindle 41 into a groove 311 in an inner periphery of a shank 310 of the outside handle 31, thereby coupling the outside handle 31 with the outside spindle 41. The outside spindle 41 further includes a pair of diametrically opposed coupling grooves 414 in an outer periphery thereof. The outside spindle 41 further includes a notch 413 in an outer end thereof and angularly spaced from either coupling groove 414 by 90°. The notch 413 of the outside spindle 41 engages with a protrusion 313 on the inner periphery of the shank 310 of the outside handle 31. Thus, when the outside handle 31 is turned, the outside spindle 41 is turned for retracting the retractor 52.

Figure 3:
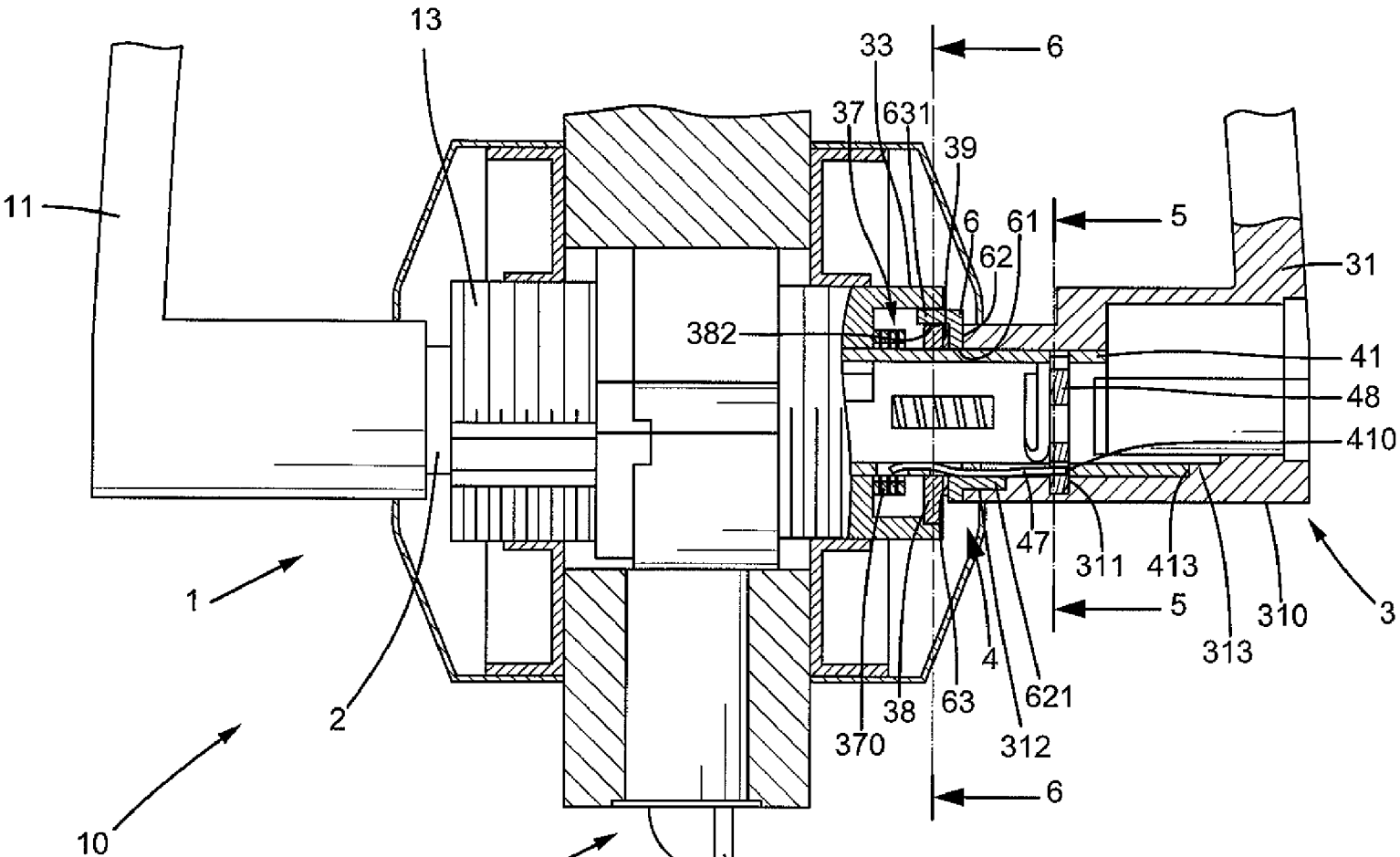
FIG. 3 is a sectional view of the lock of FIG. 2.
Figure 4:
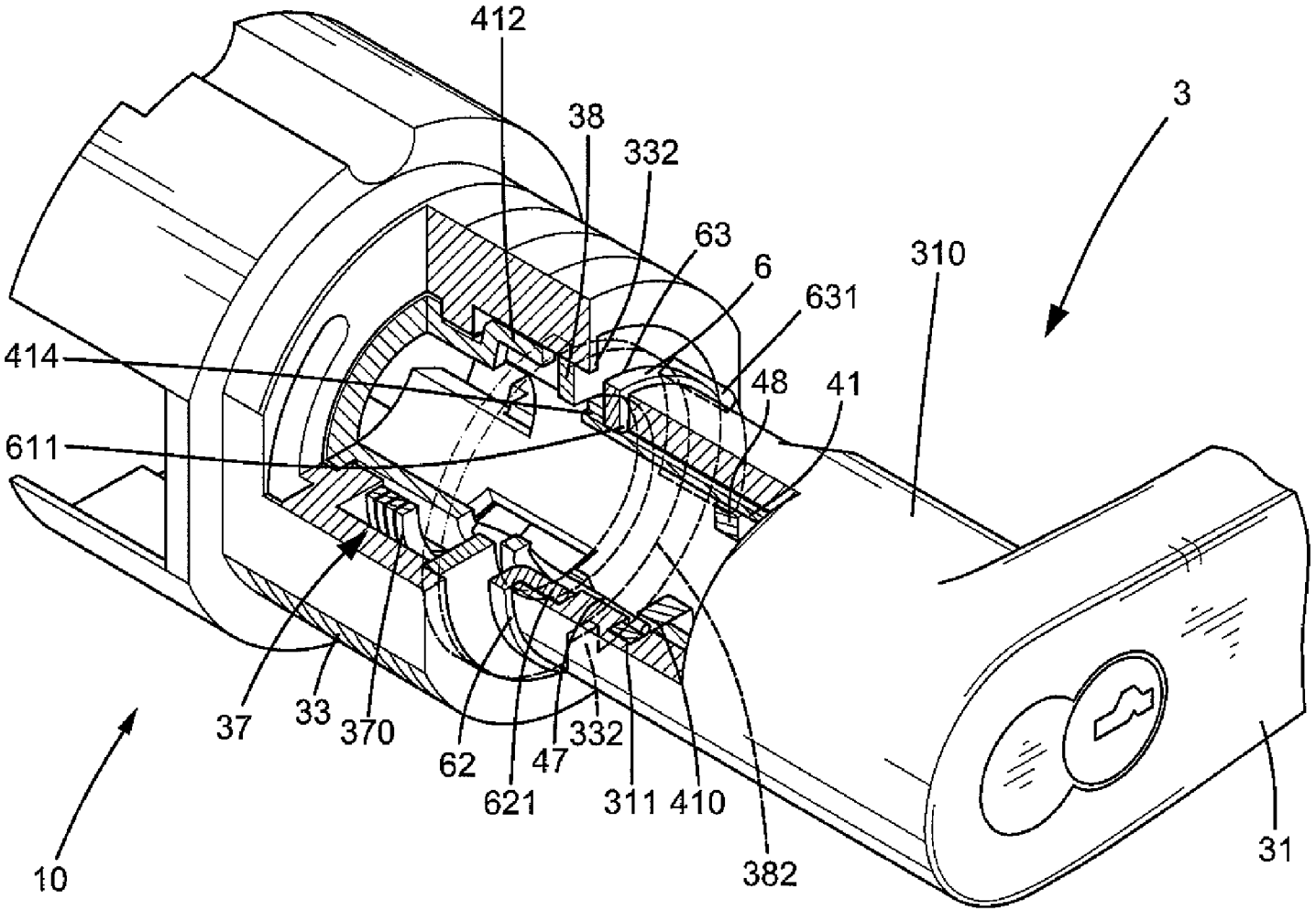
FIG. 4 is a perspective view, partly cutaway, illustrating the reinforced handle assembly in accordance with the present invention.
Figure 5:
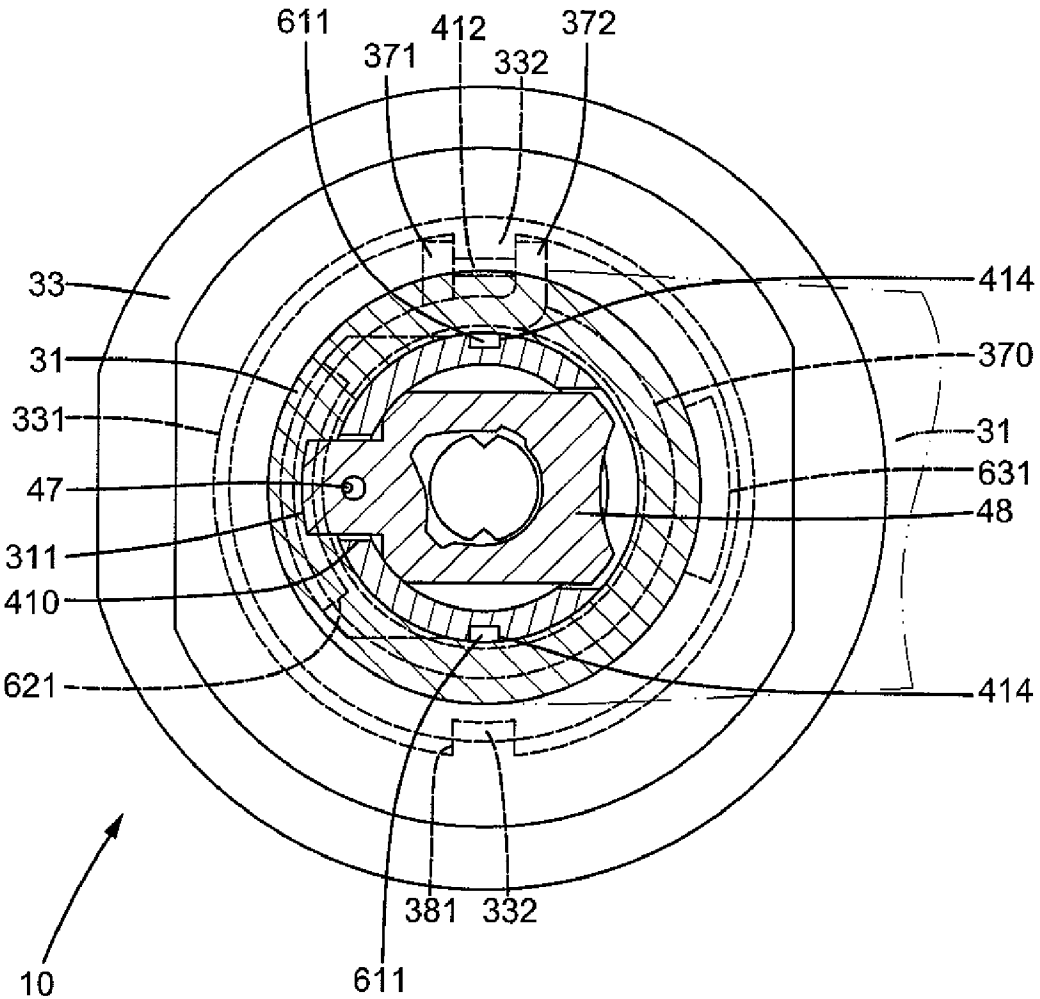
FIG. 5 is a sectional view taken along plane 5-5 in FIG. 3.
Figure 6:
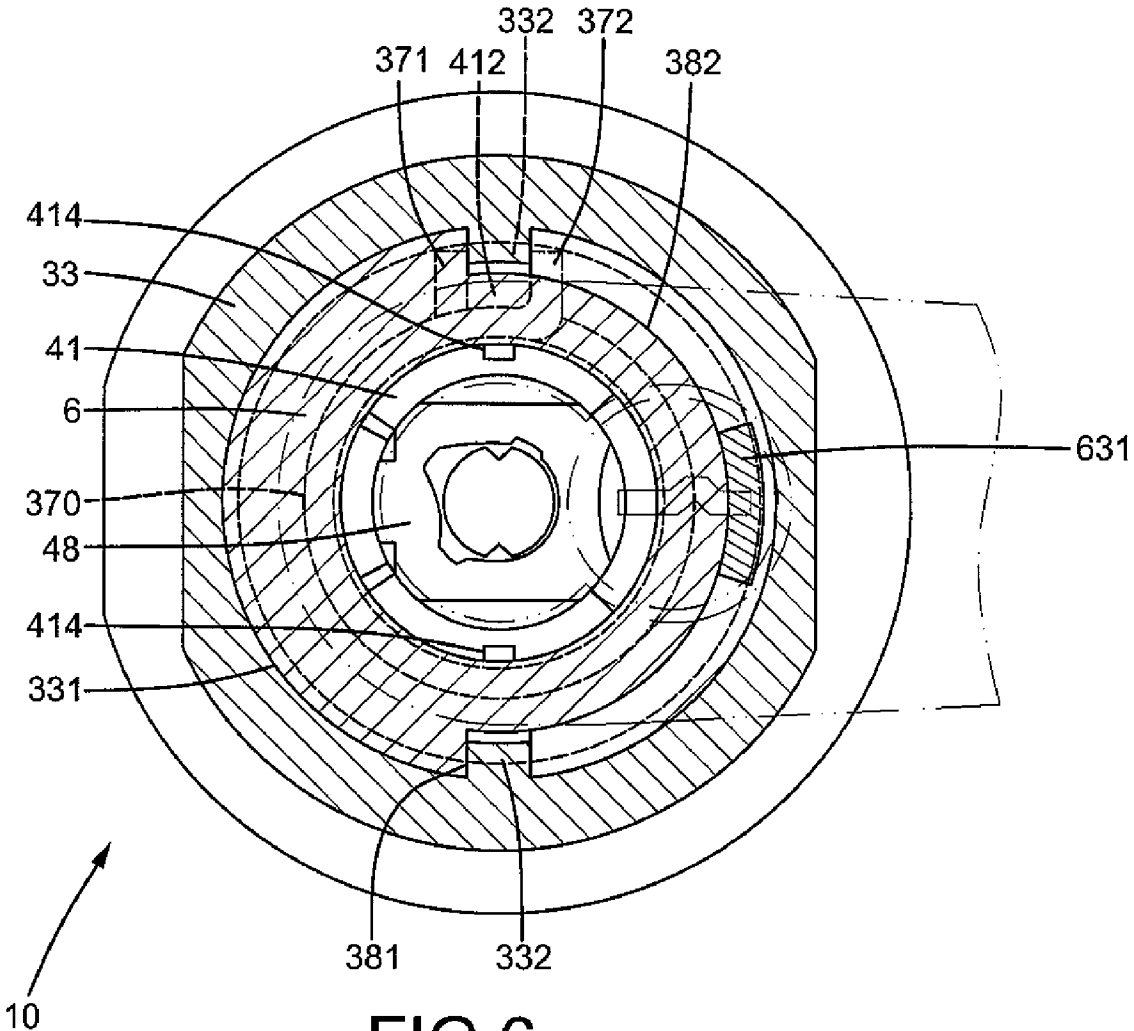
FIG. 6 is a sectional view taken along plane 6-6 in FIG. 3.
Figure 7:
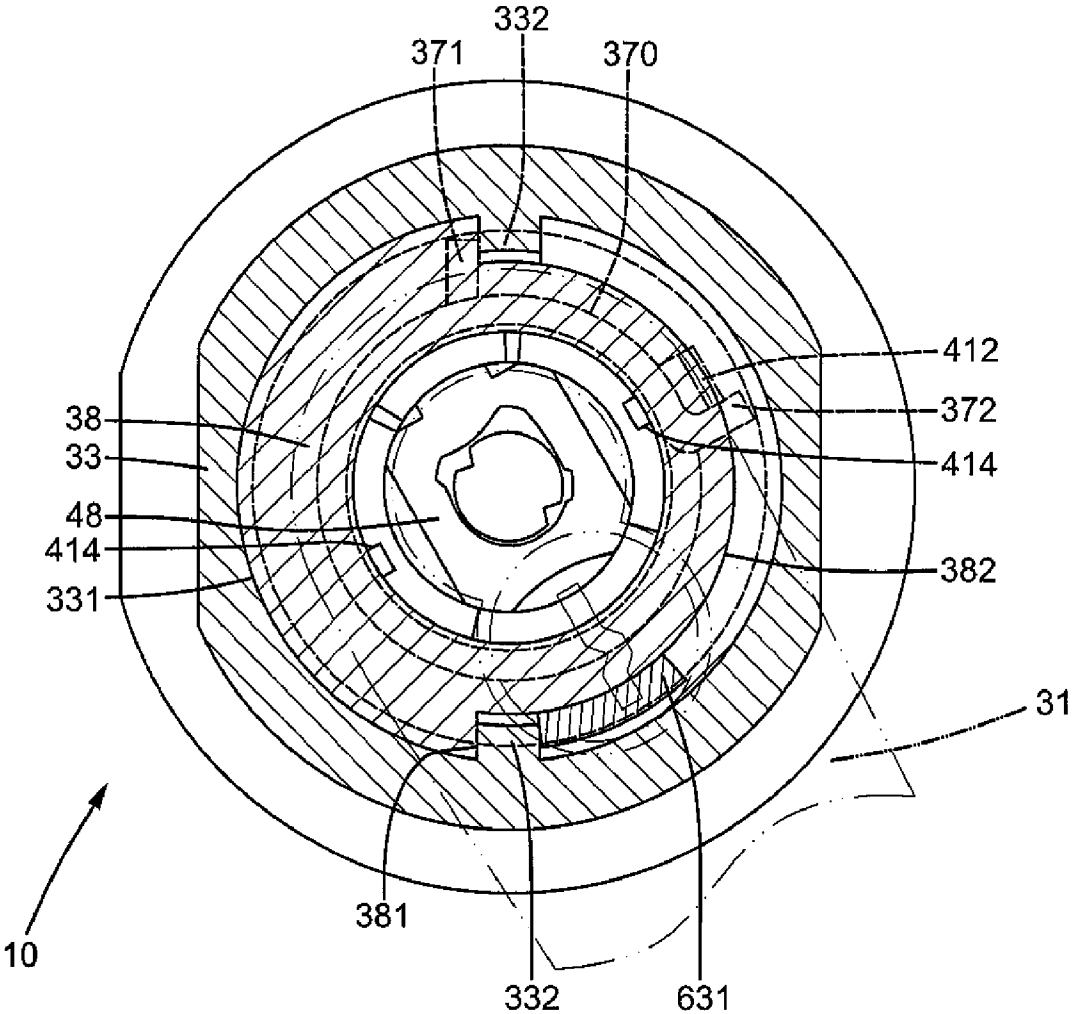
FIG. 7 is a view similar to FIG. 6, wherein the outside handle is stopped after turning through a pre-determined angle.

Referring to FIGS. 3 and 6, an elastic element 37 is mounted between an inner periphery of an end 331 of the outside hub 33 and an outer periphery of the outside spindle 41. The outside hub 33 includes a pair of diametrically opposed protrusions 332 on an inner periphery thereof. The elastic element 37 in this embodiment is a torsion spring 370 having two tangs 371 and 372 respectively pressing against two sides of one of the protrusions 332 (FIG. 5) on the inner periphery of the outside hub 33. Referring to FIG. 7, when the outside spindle 41 is turned together with the outside handle 31, one of the ends (e.g., the tang 372) of the torsion spring 370 is carried by a lug 412 on the outside spindle 41, storing energy for subsequently returning the outside spindle 41 when the outside handle 31 is released.

A positioning ring 38 is mounted between the inner periphery of the end 331 of the outside hub 33 and the outer periphery of the outside spindle 41. The positioning ring 38 is located closer to the outer end of the outside spindle 41 than the torsion spring 370 and, thus, avoids undesired disengagement of the torsion spring 370. A retainer ring 39 is mounted around the outside spindle 41 at a location closer to the outer end of the outside spindle 41 than the positioning ring 38 and, thus, fixes the longitudinal position of the positioning ring 38. The positioning ring 38 includes an engaging groove 382 in an outer periphery thereof. Two end walls 381 delimiting the engaging groove 382 of the positioning ring 38 respectively abut against the protrusions 332 of the outside hub 33 when the positioning ring 38 is mounted around the outside spindle 41.

A transmission member 6 is fixedly mounted to a front end of the shank 310 of the outside handle 31 to turn therewith. The transmission member 6 is substantially a ring having a longitudinal hole 61 so as to be mounted around the outside spindle 41. Furthermore, the ring includes an inner side 63 facing the outside hub 33 and an outer side 62 facing the shank 310 of the outside handle 31, with an engaging portion 621 formed on the outer side 62 of the ring and with a stop 631 formed on the inner side 63 of the ring. In the preferred form shown, the engaging portion 621 is in the form of a protrusion for coupling with a recess 312 in the inner periphery of the shank 310 of the outside handle 31, allowing joint rotation of the outside handle 31 and the transmission member 6. The stop 631 is in the form of a protrusion projecting from the inner side 63 of the transmission member 6, extending along the longitudinal direction of the outside spindle 41, and angularly spaced from the engaging portion 621 by 180°. After assembly, the transmission member 6 is mounted around the outside spindle 41 (FIG. 3), with the stop 631 movably extending through the restraining groove 382 of the positioning ring 38 and between the protrusions 332 of the outside hub 33. When the outside handle 31 is turned, the stop 631 is slideable in the restraining groove 382 until it is stopped by one of the two end walls 381 delimiting the restraining groove 382. Thus, the stop 631 may move through a predetermined angle (e.g., 45 degrees or 60 degrees), which is the predetermined rotational angle of the outside handle 31.

The transmission member 6 further includes a pair of diametrically opposed keys 611 formed on an inner periphery defining the longitudinal hole 61. Each key 611 is angularly spaced from the engaging portion 621 by 90°. The keys 611 are respectively engaged with the coupling grooves 414 of the outside spindle 41 when the transmission member 6 is mounted around the outside spindle 41. In this position, a relative angular position between the transmission member 6 and the outside hub 33 is fixed so that the stop 631 of the transmission member 6 is received in the restraining groove 382 of the positioning ring 38 and that the outside handle 31 is in a horizontal position when the recess 312 of the outside handle 31 is aligned and coupled with the engaging portion 621 of the transmission member 6. Engagement of the keys 611 of the transmission member 6 and the coupling grooves 414 of the outside spindle 41 further assures that the engaging portion 621 of the transmission member 6 is received in the recess 312 of the outside handle 31 when the engaging plate 48 is engaged with the groove 311 of the outside handle 31 while the notch 413 of the outside spindle 41 is aligned and coupled with the protrusion 313 of the outside handle 31. This facilitates easy assembly of the lock 10 according to the preferred teachings of the present invention. This is because the relative angular position between the keys 611 and the engaging portion 621 of the transmission member 6 is the same as that between the coupling grooves 414 and the notch 413 of the outside spindle 41 and because the recess 312 and the protrusion 313 of the shank 310 of the outside handle 31 are aligned with each other.

Regardless of the locking/unlocking state of the lock, when either handle (e.g., the outside handle 31) is turned, the outside spindle 41 and the transmission member 6 are also turned until the stop 631 of the transmission member 6 is stopped by one of the protrusions 332 of the outside hub 33, as shown in FIG. 7. In this case, if a further rotational force or torque in the same direction is applied to the outside handle 31, the torque applied to the outside handle 31 can be imparted to the outside hub 33 via the transmission member 6, for the stop 631 of the transmission member 6 is stopped by one of the protrusions 332 of the outside hub 33. Thus, impact from the outside handle 31 can be partly transmitted to the outside hub 33 and then to the door on which the lock 10 is mounted, instead of completely transmitted to the outside spindle 41. Damage to the outside spindle 41 is thus, less likely to occur. When the outside handle 31 is released, the outside handle 31 and the outside spindle 41 as well as the transmission member 6 are returned to a position shown in FIG. 6.

In a case that the lock 10 includes an arrangement allowing free rotation of the outside handle 31 without moving the retractor 52 in a locked state, operation of the transmission member 6 is substantially the same. Specifically, the outside handle 31 turns freely if a rotational force is applied to the outside handle 31 of the lock 10 in a locked state. Meanwhile, the outside spindle 41 and the transmission member 6 are also turned until the stop 631 of the transmission member 6 is stopped by one of the protrusions 332 of the outside hub 33. If a further rotational force or torque in the same direction is applied to the outside handle 31, the torque applied to the outside handle 31 can be imparted to the outside hub 33 via the transmission member 6, for the stop 631 of the transmission member 6 is stopped by one of the protrusions 332 of the outside hub 33. Thus, impact from the outside handle 31 can be partly transmitted to the outside hub 33 and then to the door on which the lock is mounted, instead of completely transmitted to the outside spindle 41. Damage to the outside spindle 41 is, thus, less likely to occur. The arrangement allowing free rotation of the outside handle 31 in a locked state may include but not limited to currently commercially available structures, and an example of which is disclosed in U.S. Pat. No. 6,705,138, the entire contents of which are incorporated herein by reference. Combination of the transmission member 6 with a lock with a handle that turns freely in a locked state would be readily apparent after reading and understanding the preferred teachings of the present invention. Damage to the internal parts of the lock is avoided by the arrangement according to the preferred teachings of the present invention regardless of the locking/unlocking state of the lock.

The reinforced handle assembly in the illustrated embodiment is the outside handle assembly 3. In an alternative example, the inside handle assembly 1 can be reinforced instead of the outside handle assembly 3. In this case, the transmission member 6 is fixed to a shank 110 of the inside handle 11 to turn therewith, and the impact from the inside handle 11 can be imparted to the inside hub 13 to avoid damage to the inside spindle 2. In another alternative example, the lock 10 can include reinforced inside and outside handle assemblies 1 and 3. The positioning ring 38 and the retainer ring 39 may be omitted without adversely affecting operation of the transmission member 6. The number of the keys 611 of the transmission member 6 and corresponding number of the coupling grooves 414 of the outside spindle 41 may be varied according to need. As an example, the transmission member 6 can include only one key 611 whereas the outside spindle 41 can include only one coupling groove 414.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A lock comprising:

a handle including a shank having a recess in an inner periphery thereof;

a hub including a pair of protrusions formed on an inner periphery thereof and angularly spaced from each other;

a spindle rotatably mounted in the hub about a rotating axis extending along a longitudinal direction, with the spindle coupled to the handle to turn therewith; and a transmission member fixed to the handle to turn therewith, with the transmission member being a ring mounted around and securely engaged with the spindle, with the ring including an inner side facing the hub and an outer side facing away from the hub and spaced from the inner side in the longitudinal direction, with each of the inner and outer sides of the ring extending in a radial direction perpendicular to the rotating axis, with the ring further including an outer circular periphery extending between the inner and outer sides, with the ring further including a longitudinal hole through which the spindle extends, with the longitudinal hole extending from the inner side through the outer side in the longitudinal direction and having an inner circular periphery extending between the inner and outer sides and spaced from the outer circular periphery in the radial direction, with an arcuate stop extending contiguously with and perpendicularly to the inner side of the ring and parallel to the rotating axis in the longitudinal direction, with the arcuate stop being radially outwards of the longitudinal hole and extending concentrically with the longitudinal hole, and with the ring slideable between the protrusions of the hub when the handle is turned, with an arcuate engaging portion extending contiguously with and perpendicularly to the outer side of the ring and parallel to the rotating axis in the longitudinal direction and extending concentrically with the outer circular periphery, with the arcuate engaging portion spaced from the outer circular periphery in the radial direction towards the spindle, with the spindle received within and slideable relative to arcuate engaging portion, with the arcuate engaging portion directly received within the recess of the shank of the handle to allow joint rotation of the transmission member and the handle, wherein the arcuate stop engages with and is stopped by one of the protrusions of the hub after the handle has been turned through an angle by a rotational force, and wherein when a torque is applied to the handle that has been turned through the angle, the torque is imparted to the hub via the transmission member preventing the spindle from being damaged by the torque.

2. The lock as claimed in claim 1, with the spindle further including a coupling groove extending in the longitudinal direction and the radial direction in an outer periphery of the spindle, with the ring further including a key extending inward in the radial direction from the inner periphery defining the longitudinal hole, with the key coextensive with the longitudinal hole in the longitudinal direction, with the key of the ring engaged in the coupling groove of the spindle to prevent relative rotation between the ring and the spindle about the rotating axis of the handle, and with the recess of the shank being coupled with the engaging portion of the transmission member while the key of the transmission member is coupled with the coupling groove of the spindle.

3. The lock as claimed in claim 2, with the key being angularly spaced from the engaging portion by a first angle, with the spindle further including a notch angularly spaced from the coupling groove by a second angle the same as the first angle, with the shank of the handle further including a protrusion on the inner periphery thereof and aligned with the recess in the longitudinal direction, with the notch of the spindle being coupled with the protrusion of the handle to allow joint rotation of the handle and the spindle while the key of the transmission member is coupled with the coupling groove of the spindle.

4. The lock as claimed in claim 1, further comprising: a torsion spring mounted around the spindle and including two tangs respectively pressing against two sides of one of the protrusions of the hub; and a positioning ring mounted around the spindle and intermediate the torsion spring and the inner side of the transmission member in the longitudinal direction, with the positioning member preventing disengagement of the torsion spring from the hub, with the positioning ring including a restraining groove in an outer periphery thereof, with two end walls delimiting the restraining groove respectively abutting against the protrusions of the hub, and with the stop of the transmission member slideably extending through the restraining groove of the positioning ring.

5. The lock as claimed in claim 4, with the spindle further including a coupling groove extending in the longitudinal direction and the radial direction in an outer periphery of the spindle, with the ring further including a key extending inward in the radial direction from the inner periphery defining the longitudinal hole, with the key coextensive with the longitudinal hole in the longitudinal direction, with the key of the ring engaged in the coupling groove of the spindle to prevent relative rotation between the ring and the spindle about the rotating axis of the handle, and with the recess of the shank being coupled with the engaging portion of the transmission member while the key of the transmission member is coupled with the coupling groove of the spindle.

6. The lock as claimed in claim 5, with the key being angularly spaced from the engaging portion by a first angle, with the spindle further including a notch angularly spaced from the coupling groove by a second angle the same as the first angle, with the shank of the handle further including a protrusion on the inner periphery thereof and aligned with the recess in the longitudinal direction, with the notch of the spindle being coupled with the protrusion of the handle to allow joint rotation of the handle and the spindle while the key of the transmission member is coupled with the coupling groove of the spindle.

* * * * *